US005387840A

United States Patent [19]

Noteleteirs et al.

[11] Patent Number: 5,387,840

[45] Date of Patent: Feb. 7, 1995

[54] ELECTRIC LAMP HAVING CURRENT CONDUCTORS WITH A METAL PHOSPHIDE COATING ONLY ON EXPOSED PORTIONS THEREOF

[75] Inventors: Victor R. Noteleteirs; Leo F. M. Ooms, Turnhout, both of Belgium

[73] Assignee: U.S. Philips Corporation, New York, N.Y.

[21] Appl. No.: 1,983

[22] Filed: Jan. 8, 1993

[30] Foreign Application Priority Data

Jan. 17, 1992 [EP] European Pat. Off. ..... 92200126

[51] Int. Cl.[6] ..... H01J 5/46

[52] U.S. Cl. ..... 313/623; 313/613; 313/626; 313/332; 174/50.61

[58] Field of Search ..... 313/579, 613, 623, 626, 313/633, 240, 274, 285, 286, 331, 332; 174/50.64, 50.61; 445/58; 427/66, 67, 70, 255.4

[56] References Cited

U.S. PATENT DOCUMENTS

| | | | |
|---|---|---|---|
| 3,721,852 | 3/1973 | Chiola et al. | 174/50.64 |
| 3,723,792 | 3/1973 | Chiola et al. | 313/331 |
| 3,798,058 | 3/1974 | Chiola et al. . | |
| 4,835,439 | 5/1989 | Essock et al. | 313/332 |

*Primary Examiner*—Donald J. Yusko
*Assistant Examiner*—N. D. Patel
*Attorney, Agent, or Firm*—Brian J. Wieghaus

[57] ABSTRACT

The electric lamp has a glass lamp vessel in the wall of which current conductors of molybdenum or tungsten are accommodated, which extend to the outside. Exclusively where the current conductors are in contact with gas, they have a skin of their own phosphide. The skin protects the current conductors from being progressively oxidized. The lamps can easily be manufactured.

9 Claims, 1 Drawing Sheet

ELECTRIC LAMP HAVING CURRENT CONDUCTORS WITH A METAL PHOSPHIDE COATING ONLY ON EXPOSED PORTIONS THEREOF

BACKGROUND OF THE INVENTION

The invention relates to an electric lamp comprising:

a glass lamp vessel closed in a gaslight manner and having a wall in which metal current conductors are enclosed, which conductors issue from the lamp vessel to the exterior;

an electric element in the lamp vessel, electrically connected to the current conductors;

a gas filling in the lamp vessel, the current conductors having a surface layer of metal phosphide.

Such an electric lamp is known from U.S. Pat. No. 3,798,058.

The known lamp is an electric incandescent lamp with a quartz glass lamp vessel. The current conductors are each built up from a metal foil which is enclosed in a pinch seal, and a metal wire connected thereto and issuing from the lamp to the exterior. An inner conductor made of molybdenum is fastened to the metal foil and connects the current conductor to the incandescent body.

Prior to lamp manufacture, the current conductors with the inner conductors fastened thereto are coated with tungsten phosphide or molybdenum phosphide by description.

The purpose of the coating is to protect the current conductors against oxidation during lamp manufacture, especially during heating of the lamp vessel while its seals are being made. Oxidation of the current conductors may lead to leaks in the lamp.

The coating also envisages to protect portions of the current conductors which are in contact with the atmosphere surrounding the lamp during lamp operation against oxidation. Since an oxide skin does not inhibit progressive oxidation and since the oxides are more voluminous than the metals, progressive oxidation of the current conductors leads to stresses in the lamp vessel, to chipping of glass and leaks in the lamp vessel, possibly resulting in its explosion.

The rate at which the current conductors are oxidized increases strongly with the temperatures which these conductors assume during operation. Lamp life accordingly decreases strongly with increasing operational temperature. According to IEC standard 357, therefore the maximum wall temperature of the lamp vessel at the area of the current conductor enclosed therein is 400° C. and 450° C. for a rated life of at most 300 and 15 hours, respectively.

The known lamp has an appearance which is different from that of a lamp whose current conductors are not coated. The current conductors are shiny and look as if they were made of silver where they are embedded in the glass of the lamp vessel. Non-coated current conductors on the other hand are dull and have a greyish colour.

The known lamp does offer protection against oxidation of the current conductors, but it has major disadvantages.

Considerable rejects occur during lamp manufacture because the metal foil is ruptured. These rejects generally amount to approximately 20% of the number of lamps manufactured. The rejects alone cause a considerable increase in the cost of the lamp.

In addition, the manufacture of the current conductors is time-consuming. The current conductors are, for example, exposed to the vapour of a tungsten phosphate or molybdenum phosphate melt, after which they are heated at a temperature of 700°–1000° C. for at least 3 hours in a reducing atmosphere. These operations result in a further increase in cost.

SUMMARY OF THE INVENTION

It is an object of the invention to provide an electric lamp of the kind mentioned in the opening paragraph in which oxidation of the current conductors is effectively counteracted and which is nevertheless easy to manufacture while rejects are avoided.

According to the invention, this object is achieved in that the metal current conductors have a skin of substantially their phosphide exclusively in those locations where they are in contact with gas, the metal being chosen from tungsten and molybdenum.

The lamp has an excellent protection against progressive oxidation of the current conductors, also at comparatively high temperatures. High reject figures in lamp manufacture are avoided.

The lamp can be easily protected. For this purpose, the constructionally completed lamp is exposed to, for example, phosphorus vapour. The constructionally completed lamp may be entirely ready during this for radiating light upon connection to a supply source; visible, IR, or UV light. Alternatively, it is possible that the constructionally completed lamp does not yet contain the medium in its lamp vessel which renders the generation of radiation possible. The electric element of the lamp may be an incandescent body in an inert gas, for example in an inert gas to which a halogen or halogen compound has been added. Alternatively, the electric element may be a pair of electrodes in an ionizable gas filling, for example in a rare gas, to which a metal halide and/or mercury may have been added. This gas filling may yet be absent in a constructionally completed lamp. The gas filling is then provided later, for example, through an exhaust tube, after the lamp has been treated with phosphorus vapour. An exhaust tube may then be sealed up at a free end before said treatment, for example after evacuation of the lamp vessel or after the lamp vessel has been filled with an inert gas, or the exhaust tube may be open while the phosphide coating is being made.

In order to provide the protection, the constructionally completed lamp may be exposed to the vapour of red phosphorus, for example, in vacuo and at elevated temperature, for example at a temperature of a few hundreds of degrees. At a temperature of, for example, 800° C., a treatment of the order of ten minutes, for example 15 minutes, suffices.

Upon first operation of the lamp in an oxidizing environment, the portions of the current conductors in contact with this environment assume a dark blue colour as a result of oxidation. The oxidation process then stops and the lamp has become resistant to a prolonged load at a high temperature.

The lamp has features of a lamp which has current conductors not protected against oxidation: the portions embedded in the glass of the lamp vessel are dull and grey, and also features of protected current conductors: the portions in contact with the environment of the lamp are strongly coloured. Phosphorus is demonstrable on the latter portions, but not on the former portions.

The lamp vessel may be manufactured from glass with a high $SiO_2$ content by weight, for example 95% or more, such as, for example, quartz glass. Such glass has a very low linear thermal coefficient of expansion: approximately $10\times10-7K^{-1}$ or less. Tungsten and molybdenum have considerably higher coefficients of approximately 45 and $55\times10^{-7}K^{-1}$, respectively. If a current conductor is used comprising a foil which is substantially embedded in the glass of the lamp vessel and a wire connected to this foil and issuing from the wall of the lamp vessel to the exterior, it is in general only the foil which is embedded substantially vacuumtight in the glass. A capillary channel surrounding the wire extends up to the foil. The current conductor is in contact with the environment surrounding the lamp wherever the current conductor adjoins this channel. Oxidation and discoloration accordingly take place there initially, for example, upon contact with air.

The current conductor made of foil and wire may be assembled, for example by welding, or may consist of one integral piece, for example in that a wire is flattened.

A conductor providing the connection to the electric element is connected to the foil or the foil-shaped portion. This conductor may be integral with the electric element, for example, be a leg of a helically coiled incandescent body, or may alternatively be a separate component. The conductor may be, for example, a tungsten or molybdenum wire. Because of the differences in coefficient of expansion, a capillary channel extends up to the foil also around this conductor. The foil is in contact with the gas filling of the lamp around the contact location of conductor with the foil. If the foil is provided with a phosphide skin in this location, the foil is protected them as well, for example, against residual oxidizing ingredients of the gas filling.

In spite of the said differences in coefficient of expansion, tungsten or molybdenum wires may be embedded in a vacuumtight manner in glasses such as quartz glass if these wires have a coating of such a glass over a portion of their length.

The wires are then embedded in the lamp vessel wall between the ends of this coating. The wire portions projecting from the lamp vessel and not having a glass coating would be subjected to progressive oxidation without a phosphide skin. This oxidation could progress into the glass coating and into the lamp vessel wall at high temperatures and cause a premature end of lamp life.

The lamp vessel may alternatively be made of hard glass, for example, of aluminium silicate glass or aluminium borosilicate glass, for example, with an $SiO_2$ content of 55% by weight or more. Such glasses have a considerably higher linear coefficient of expansion, which may correspond to that of one of the metals. It is true that there is no elongate capillary channel around a wire forming a current conductor, but the current conductor may then issue from the lamp vessel in a tapering cavity. Progressive oxidation may take place in this cavity in the case of an unprotected current conductor, continuing in the direction of the wire and penetrating into the lamp vessel wall. A premature end of lamp life is also caused then. This is avoided in the lamp according to the invention having a hard-glass lamp vessel.

It is a very favourable property of the lamp according to the invention that the current conductors of the lamp are protected against detrimental oxidation, while nevertheless the high rejects percentage in lamp manufacture is avoided, while the said protection is easy to realise.

It is also a very favourable property that it can be avoided in the lamp according to the invention that a phosphide skin is present where the current conductors are in contact with the gas filling of the lamp. This is favourable in those cases in which the gas filling would be adversely affected by the presence of phosphide, for example, if a component of the gas filling should react with the phosphide. In this case, the phosphide skin is exclusively present where the current conductors are in contact with the environment surrounding the lamp, for example, in that the skin was provided while the lamp vessel was sealed against the phosphorus vapour. The lamp vessel is then, for example, entirely closed and provided with its gas filling, or the gas filling is provided in a subsequent manufacturing step. Heating of the lamp vessel during the provision of the phosphide may then in addition be utilized for driving adsorbed impurities from the lamp.

BRIEF DESCRIPTION OF THE DRAWINGS

Embodiments of the lamp according to the invention are shown in the drawing, in which.

DESCRIPTION OF THE PREFERRED EMBODIMENTS

Figure 1A:
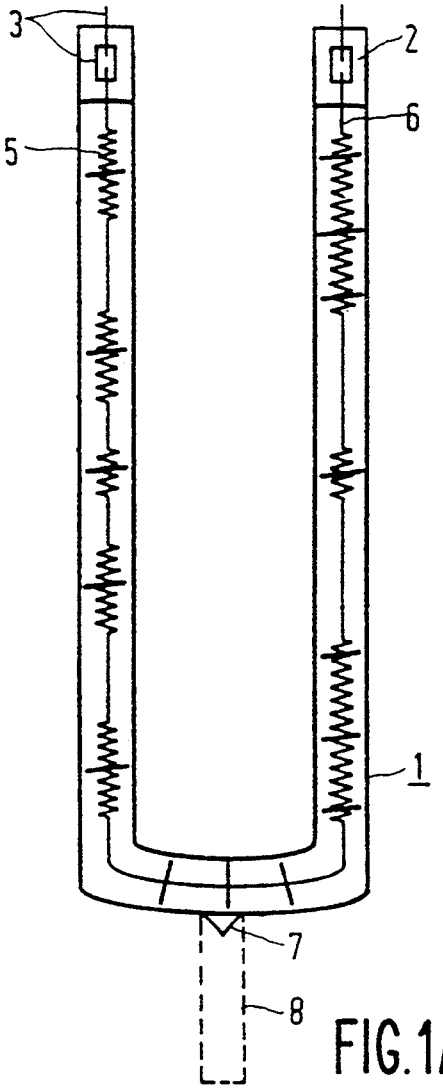
FIG. 1A shows a first embodiment in side elevation.
Figure 1B:
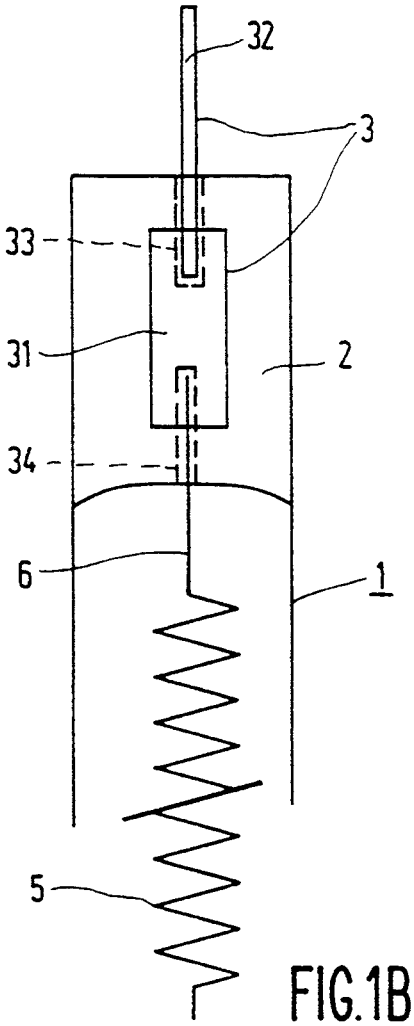
Fig. 1B is a detail of FIG. 1A.

In FIG. 1A and 1B, the electric lamp has a glass lamp vessel 1 which is closed in a gaslight manner and has a wall 2 in which metal current conductors 3 are embedded, which conductors issue from the lamp vessel to the exterior. An electric element 5 is arranged in the lamp vessel, electrically connected to the current conductors 3 by conductors 6. A gas filling is present in the lamp vessel. The current conductors 3 have a surface layer of metal phosphide.

The lamp shown is an incandescent lamp which emits mainly IR radiation and can be used, for example, for the preparation of food. The lamp vessel 1 is made of quartz glass and the gas filling is an inert gas, for example, argon/nitrogen. The gas filling is introduced into the lamp vessel through an exhaust tube 8 whose sealed tip is indicated with 7. The metal current conductors 3 comprise a molybdenum foil 31 embedded in the wall 2, to which a molybdenum wire 32 is welded. The conductor 6 in the lamp shown is a leg of the tungsten incandescent body which forms the electric element 5.

A capillary channel 33 (FIG. 1B) extends around the wire 32 up to the foil 31, so that the entire wire and a portion of the foil are in contact with the atmosphere surrounding the lamp. A similar capillary channel 34 extends around the conductor 6, so that this entire conductor and a portion of the foil are in contact with the gas which fills the lamp vessel.

The metal current conductors 3 (31, 32) have a skin of substantially their phosphide exclusively in those locations where they are in contact with gas, the metal being chosen from the group comprising tungsten and molybdenum.

When the exhaust tube 8 had not yet been tipped off at 7, the constructionally completed lamp was exposed to the vapour of red phosphorus for approximately 15 minutes at approximately 800° C. A skin of molybdenum phosphide was created by this all around the molybdenum wire 32, as well as on those portions of the foil 31 which adjoin the capillaries 33 and 34, while a skin of tungsten phosphide was formed all around the conductor 6. These coatings are visually not discernible, but they can be demonstrated by analysis. Phosphorus can be demonstrated thereby. If the treatment with red phosphorus should not have taken place for a lamp in the manner according to the invention, i.e. in advance, the portions of the current conductors embedded in the lamp vessel glass would have been silvery and bright. So metal parts have a skin of their own phosphide. When the completely finished lamp is operated in air, the wire 32 and the foil portion adjoining the capillary 33 adopt a dark blue colour as a result of an initial oxidation. The oxidation process is impeded after that.

Figure 2:
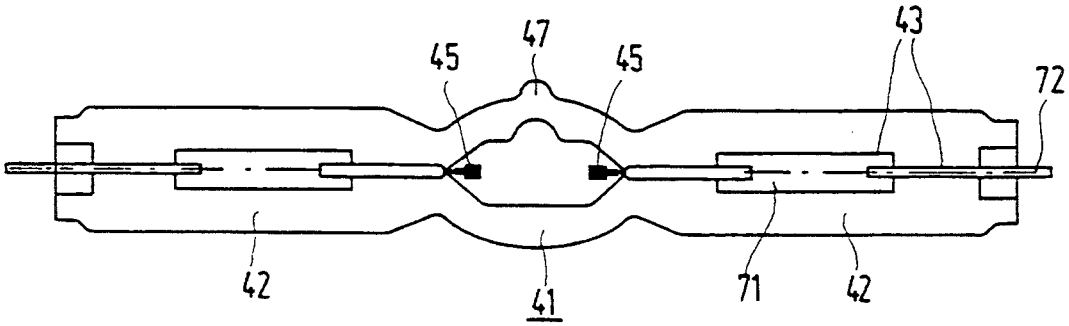
FIG. 2 shows a second embodiment in side elevation.

In FIG. 2, parts corresponding to parts of FIG. 1 have reference numerals which are 40 higher than in FIG. 1. The electric element 45 is a pair of electrodes arranged in an ionizable gas, for example, in rare gas, mercury and metal halide. Only those portions of the current conductors 43 which are in contact with the atmosphere surrounding the lamp are coated with their phosphides.

Three groups of ten halogen incandescent lamps each with molybdenum current conductors designed for use as cooker lamps, which accordingly are constructed so as to have a very long life as heat radiators, were subjected to a comparative test. The first group of lamps (A) had molybdenum current conductors without a phosphide skin. The second group (B) had molybdenum current conductors which had been entirely provided with a skin of their phosphide prior to lamp manufacture. The third group (c) had molybdenum current conductors of which exclusively those portions which are in contact with the atmosphere surrounding the lamp had coatings of their phosphides.

The lamps were heated to a temperature of 475° C. in an oven in air. It was investigated how long the lamps remained intact. All lamps A were found to be defective after 100 hours already. Two of the lamps B (20%) were already defective at the start of the test owing to rupture of the molybdenum foils arising during lamp manufacture. The remaining eight lamps B and the ten lamps C were still fully intact after being heated for 600 hours.

The lamps according to the invention, therefore, withstand a higher temperature than the maximum temperature of 450° C. allowed for the current lead-through of a lamp with a calculated life of no more than 15 hours according to the IEC standard 357 for a very long period.

We claim:

1. An electric lamp, comprising:

a glass lamp vessel energizeable for emitting light, a gas filling and an electric element within said lamp vessel, said lamp vessel having a wall and a metal current conductor extending in contact with said wall from the electric element through the wall of the lamp vessel to the exterior, the metal current conductor having a layer of substantially the phosphide of its respective metal, the layer being exclusively in those location where the current conductor ids not in contact with the wall of the lamp vessel.

2. An electric lamp as claimed in claim 1, characterized in that the phosphide skin is exclusively present where the metal current conductors are in contact with the atmosphere surrounding the lamp.

3. An electric lamp according to claim 2, wherein said metal current conductor comprises a metal selected from the group consisting of tungsten and molybdenum.

4. An electric lamp, comprising:

a glass lamp vessel closed in a gas-tight manner and having a wall;

a gas filling and an electric element within said lamp vessel; and metal current conductors extending from the electric element through the wall of the lamp vessel to the exterior thereof, the portion of the current conductors exterior to the lamp vessel being exposed to a gas atmosphere, the current conductors including a layer of a phosphide of the metal of the current conductor, said layer being present exclusively in at least one of:

(i) the portions of the current supply conductors exposed to the gas filling within the lamp vessel; and (ii) the portions of the current supply conductors exposed to the gas atmosphere exterior to the lamp vessel.

5. An electric lamp according to claim 4, wherein said lamp is a high pressure discharge lamp in which said electric element comprises a pair of discharge electrodes and said gas filling includes a rare gas and mercury.

6. An electric lamp according to claim 5, wherein said gas fill further includes a metal halide.

7. An electric lamp according to claim 4, wherein said lamp is an incandescent lamp in which said electric element is an incandescent filament and said gas filling includes an inert gas.

8. An electric lamp as claimed in claim 4, characterized in that the phosphide skin is exclusively present where the metal current conductors are in contact with the atmosphere surrounding the lamp.

9. An electric lamp according to claim 4, wherein said metal current conductor comprises a metal selected from the group consisting of tungsten and molybdenum.

* * * * *